US006609890B2

(12) United States Patent
Budris et al.

(10) Patent No.: US 6,609,890 B2
(45) Date of Patent: Aug. 26, 2003

(54) IMPELLER ASSEMBLY FOR CENTRIFUGAL PUMP

(75) Inventors: Allan R. Budris, Geneva, NY (US); Mohammed Merah, Seneca Falls, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/055,129

(22) Filed: Jan. 23, 2002

(65) Prior Publication Data

US 2003/0138314 A1 Jul. 24, 2003

(51) Int. Cl.[7] ..... F04D 29/20

(52) U.S. Cl. ..... 416/1; 416/234; 416/245 R

(58) Field of Search ..... 416/244 R, 245 R, 416/234, 146 R, 1; 415/121.1, 121.2, 216.1

*Primary Examiner*—Edward K. Look
*Assistant Examiner*—Dwayne White

(57) ABSTRACT

An impeller assembly for reducing blockage at the inlet of a centrifugal pump includes an impeller having an inlet side and a bearing hub, wherein the bearing hub extends axially outwardly from the inlet side of the impeller. A conical floating sleeve is mounted on the bearing hub and held in place by a detachable retainer. The mating surfaces of either the bearing or the conical floating sleeve may be coated with a polymer to reduce surface friction. The bearing hub of the impeller may also be bored to receive a drive shaft.

24 Claims, 3 Drawing Sheets

IMPELLER ASSEMBLY FOR CENTRIFUGAL PUMP

FIELD OF THE INVENTION

This invention relates to centrifugal pumps, and, more particularly, to an improved impeller hub assembly for centrifugal pumps.

BACKGROUND OF THE INVENTION

Centrifugal pumps are well known and widely used in many different environments and applications. A centrifugal pump typically includes a wheel fitted with vanes or blades, known as an impeller. The impeller imparts motion to the fluid which is directed through the pump. A centrifugal pump provides a relatively steady fluid flow. The pressure for achieving the required head is produced by centrifugal acceleration of the fluid in the rotating impeller. The fluid flows axially toward the impeller, is deflected by the blades, and flows out through apertures between the blades. Thus, the fluid undergoes a change in direction and is accelerated. This produces an increase in the pressure at the pump outlet. As the fluid leaves the impeller, the fluid may first pass through a ring of fixed diffusion vanes surrounding the impeller, commonly referred to as a diffuser. In this device, with gradually widening passages, the velocity of the liquid is reduced, and its kinetic energy is converted into pressure energy. In some centrifugal pumps, however, there is no diffuser and the fluid passes directly from the impeller to the volute. The volute is a gradual widening of the spiral casing of the pump.

Centrifugal pump impellers typically include an integrally formed impeller hub. The impeller hub, which may be cylindrical in configuration, extends axially upstream of impeller blades and rotates with the impeller. Alternatively, the impeller hub is truncated so that it does not extend axially from the inlet side of the impeller. All pump impellers, including those with integrally formed hubs or those with little or no hub, experience flow re-circulation at reduced flow rates, and typical solids handling impeller designs experience flow re-circulation over most of the usable flow range of the pump.

Impellers are used to pump liquefied materials that may contain fibrous strands of matter. The fibrous strands of matter may comprise, for example, recycled waste paper stock, plastic fibers from newspaper banding, plastic book covers, and soft drink containers, along with metal staples or other foreign matter that may be contained therein.

When liquefied materials containing fibrous material are pumped through impellers with integrally formed hubs, there is a tendency for the long fibers to wrap around the impeller hub, to collect in dead spaces where there is no through flow, to accumulate, and block the flow of liquid to and through the impeller. This type of pump blockage is especially problematic for, although not limited to, pumps having cylindrical shaped impeller hubs that extend upstream or in front of the impeller vanes.

Pumps having little or no extending hub at the inlet are also prone to blockage. For example, when pumping liquid that includes long stringy fibers with impellers having little or no hub at the inlet, the fibers that are lighter (lower in density) than the pumped liquid will collect in the eye of the impeller when there is suction flow re-circulation in the impeller. The rotation of the re-circulating liquid forces the fibers to the center of the impeller eye by centrifugal force, thus forming a ball which blocks the inlet flow to the impeller.

An improved impeller apparatus for centrifugal pumps and method for avoiding the aforementioned problems are therefore desirable.

SUMMARY OF THE INVENTION

Briefly described, the invention provides an impeller assembly for centrifugal pumps. The assembly includes an impeller having an axially outwardly extending hub with a loose conical sleeve rotatably mounted thereon. The assembly reduces blockage encountered on the inlet side of the impeller when pumping liquefied materials.

In one embodiment, the impeller assembly includes an impeller having an inlet side and a bearing hub, wherein the bearing hub extends axially outward from the inlet side of the impeller. A conical sleeve is rotatably mounted on the bearing hub. The mating surfaces of either the bearing or the conical floating sleeve may be coated with a polymer to reduce surface friction. The bearing hub may also be bored to receive a drive shaft.

According to another embodiment of the invention, a method for reducing blockage at the inlet of an impeller assembly is provided and includes the step of: pumping pumpage through an impeller assembly having a conical sleeve rotatably mounted on the inlet side of the impeller.

BRIEF DESCRIPTION OF THE DRAWINGS

Other aspects, advantages and novel features of the invention will become more apparent from the following detailed description of the invention when considered in conjunction with the accompanying drawings wherein.

DETAILED DESCRIPTION OF THE INVENTION

Figure 1:
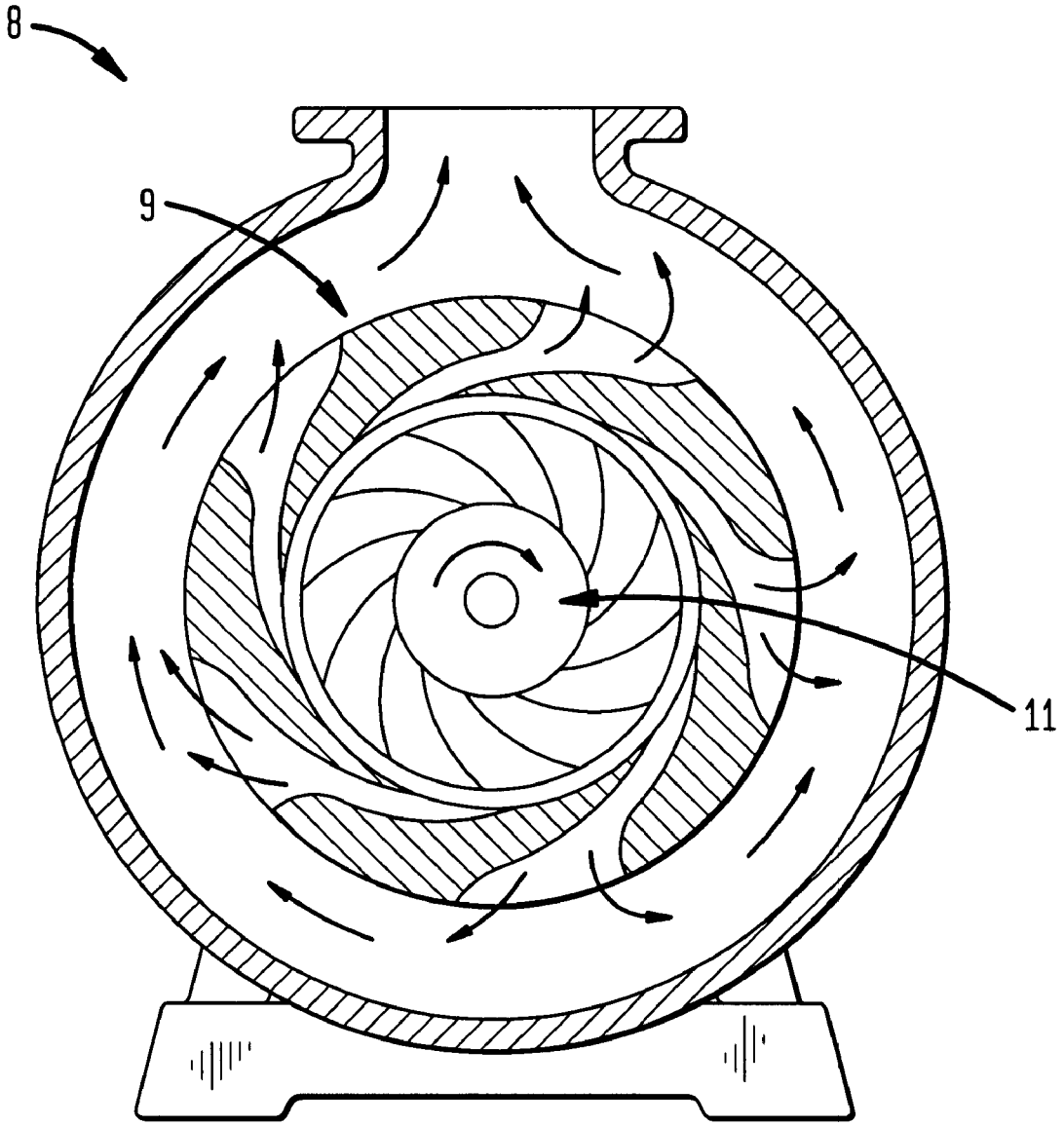
FIG. 1 (PRIOR ART)
FIG. 1 is a cross-sectional view of a centrifugal pump including an impeller with diffusion vanes.
Figure 2:
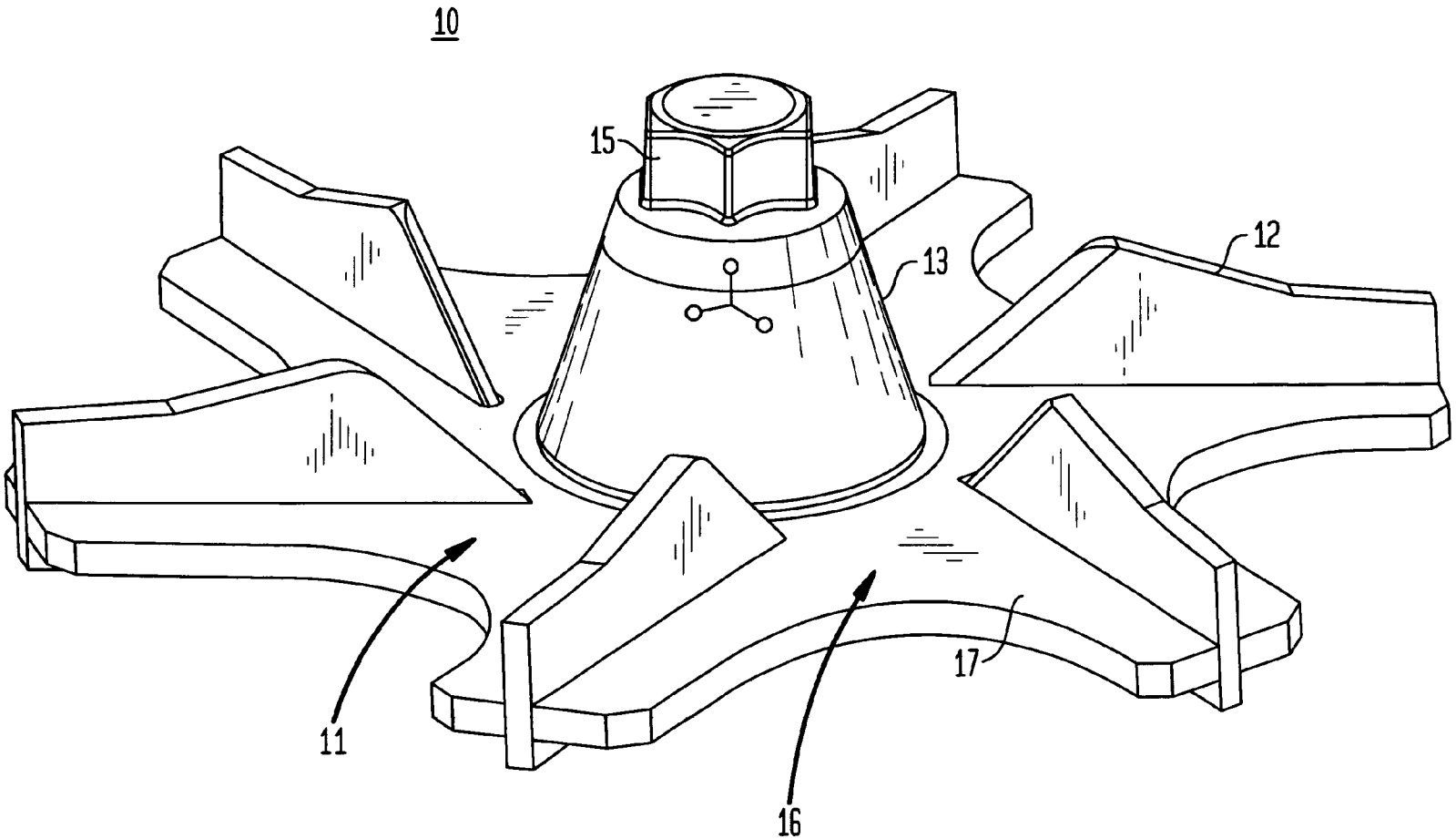
FIG. 2 is an isometric view of an exemplary embodiment of an impeller assembly according to the invention.
Figure 3:
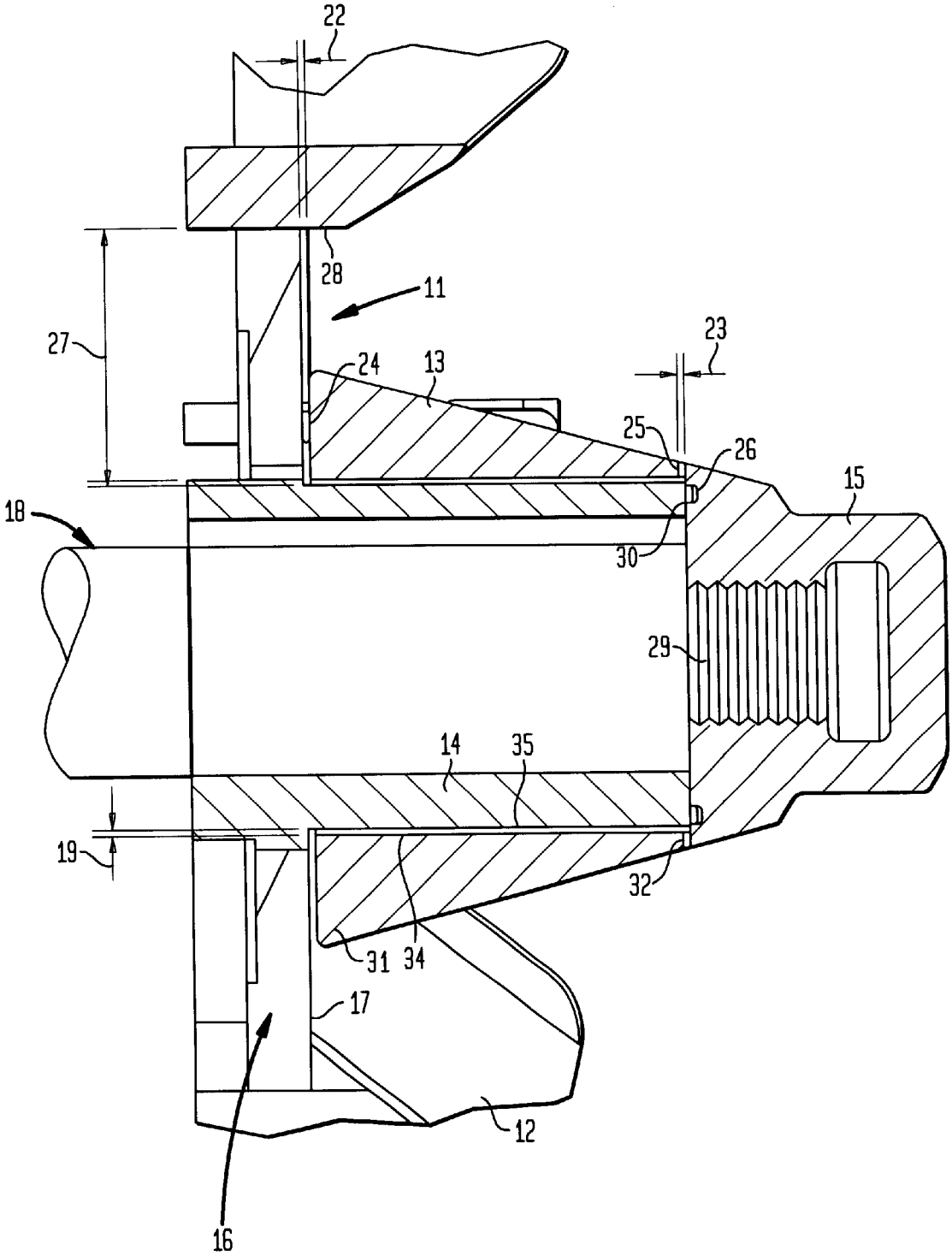
FIG. 3 is a cross-sectional view of the impeller assembly of FIG. 2.

FIG. 1 illustrates a typical centrifugal pump 8 that includes an impeller 11. As can be seen, the pump includes diffusion vanes 9. FIGS. 2 and 3 illustrate an impeller assembly 10 for a centrifugal pump 8, according a preferred embodiment of the invention. The impeller assembly 10 includes an impeller 11 having a plurality of radially disposed impeller blades 12 and an integrally formed bearing hub 14. A loose, substantially conically-shaped sleeve 13 is mounted on an axially extending portion of the bearing hub 14 provided on the inlet side of the impeller 11. When rotatably mounted on the bearing hub 14, the conical sleeve 13 is free to rotate separately from the impeller 11. A retainer 15 is used to secure the conical sleeve 13 to the bearing hub 14.

As illustrated in FIG. 2, impeller 11 includes a base 16 having six radially disposed blades 12 mounted thereon. The blades 12 extend radially inward from the periphery of the impeller 11 toward the bearing hub 14. The impeller blades 12 may vary in size, shape, quantity, and orientation to optimize pump performance, depending upon the specific application. The base 16 should have at least one blade 12 disposed thereon. The radially innermost portion 28 of blades 12 and the bearing hub 14 define an area, referred to as the "impeller eye" 27.

Referring to FIG. 3, bearing hub 14 extends axially outward (i.e., upstream) from the inlet face 17 of the impeller 11 and is bored to receive a drive shaft 18. A conical sleeve 13 is rotatably mounted on bearing hub 14 of impeller 11. The conical sleeve 13 is free to rotate separately from the bearing hub 14, as there is a radial gap 19 between the bearing hub 14 outer surface 35 and the inner bore 34 of conical sleeve 13. The conical sleeve 13 has a large diameter end 31 and a small diameter end 32. The small diameter end 32 is positioned upstream of the large diameter end 31. When oriented in this manner, the conical sleeve 13 tapers outwardly from the small diameter end 32 toward the large diameter end 31 as it extends toward impeller inlet face 17. The tapered profile of the conical sleeve 13 can be seen in FIG. 3.

The conical sleeve 13 may be constructed of a bearing type or polymer material having a low coefficient of friction, preferably a TEFLON compound. TEFLON, also known as polytetrafluoroethylene, is a registered trademark of DuPont. A surface of the conical sleeve 13 and/or the bearing surface of the bearing hub 14 may also be coated with a material with a low coefficient of friction. It will be understood by those skilled in the art that other floating sleeve configurations are also possible, and may be desirable, depending on the particular pumping conditions, pumpage material, and desired application.

Referring to FIGS. 2 and 3, retainer 15 secures floating conical sleeve 13 on bearing hub 14. In the embodiment shown, retainer 15 is an internally threaded nut, which is detachably fastenable to a threaded end 29 of shaft 18. Retainer 15 includes a retainer face 26, which abuts an axial end 30 of bearing hub 14. In the preferred embodiment, axial gaps 22, 23 are provided between the large end face 24 of conical sleeve 13 and the impeller inlet face 17, and/or between the small end face 25 of conical sleeve 13 and retainer face 26, which permit the conical sleeve 13 to freely rotate and "float" on the bearing hub 14. Other retainers 15 are also contemplated, within the scope of the invention, and may include any type of permanent or detachable retainer for securing the floating conical sleeve 13 on bearing hub 14. Such retainers 15 may be secured either to the drive shaft 18 or directly to the bearing hub 14.

In operation, floating conical sleeve 13 is free to stop rotating with the impeller 11 when any drag (torque) is applied to the outer surface of the sleeve, for example, by the approaching liquid, and any long tangling fibers that may attempt to wrap around the sleeve 13. Since the configuration of the conical sleeve 13 does not apply torque to the long fibers, they are free to be carried through the impeller 11 with the liquid pumpage. Also, by being constructed of a reduced friction material, the conical sleeve 13 advantageously resists the binding of long fibers around the conical sleeve 13. Further, by having the large diameter end 31 of conical sleeve 13 substantially filling the center of the impeller eye 27, there is no dead space (area without any through flow) for collecting unwanted fibers or materials that are lower in density than the density of the pumped liquid.

An exemplary application of the impeller assembly for centrifugal pumps is in handling recycled waste paper stock. Such paper stock typically contains fibers of various lengths and materials. Plastic fibers from newspaper banding, plastic book covers and soft drink containers, along with metal staples, often form long fibers or ropes, which can wrap around rotating impeller hubs. These plastic fibers are generally lighter or lower in density than the pumpage, and tend to collect in any dead spaces in the eye 27 of the impeller 11 where there is no through flow, and block the impeller inlet. The impeller assembly 10 prevents these fibers from binding around the impeller hub 14, thus preventing unwanted pump blockage at the impeller inlet face 17.

Although the invention has been described in terms of exemplary embodiments, it is not limited thereto. The appended claims should be construed broadly, to include other variants and embodiments of the invention which may be made by those skilled in the art without departing from the scope and range of equivalents of the invention.

What is claimed is:

1. An impeller assembly comprising:

an impeller having an inlet side and a bearing hub, the bearing hub extending axially outward from the inlet side of the of the impeller; and a floating sleeve mounted on the bearing hub.

2. The impeller assembly of claim 1 wherein the floating sleeve is substantially conical in shape.

3. The impeller assembly of claim 1 wherein the floating sleeve has a tapered profile.

4. The impeller assembly of claim 1 wherein the floating sleeve is radially spaced from the bearing hub.

5. The impeller assembly of claim 1 wherein mating surfaces of at least one of the bearing hub and the floating sleeve comprise a polymer.

6. The impeller assembly of claim 1 wherein the conical surface of the floating sleeve comprises a polymer.

7. The impeller assembly of claim 1 wherein the bearing hub and the impeller are integrally formed.

8. The impeller assembly of claim 1 wherein the bearing hub is bored to receive a drive shaft.

9. The impeller assembly of claim 8 further comprising a retainer that is detachably fastenable to the drive shaft.

10. The impeller assembly of claim 1 wherein the impeller has at least one blade.

11. The impeller assembly of claim 10 wherein the floating sleeve extends axially upstream of the at least one blade.

12. The impeller assembly of claim 1 further comprising a retainer for securing the floating sleeve on the bearing hub.

13. The impeller assembly of claim 12 wherein the retainer is detachably mounted to the bearing hub.

14. An impeller assembly comprising:

an impeller having at least one blade, an inlet side and an integrally formed bearing hub, the bearing hub extending axially outward from the inlet side of the of the impeller; and a floating sleeve mounted on the bearing hub, wherein the floating sleeve extends axially upstream of the at least one blade.

15. The impeller assembly of claim 14 wherein the bearing hub is bored to receive a drive shaft.

16. The impeller assembly of claim 14 wherein the floating sleeve has a tapered profile.

17. The impeller assembly of claim 14 wherein the floating sleeve is radially spaced from the bearing hub.

18. The impeller assembly of claim 14 wherein mating surfaces of at least one of the bearing hub and the floating sleeve comprise a polymer.

19. The impeller assembly of claim 14 wherein further comprising a retainer that is detachably fastenable to the drive shaft.

20. The impeller assembly of claim 14 wherein the floating sleeve is substantially conical in shape.

21. The impeller assembly of claim 20 wherein the conical surface of the floating sleeve comprises a polymer.

22. The impeller assembly of claim 14 further comprising a retainer for securing the floating sleeve on the bearing hub.

23. The impeller assembly of claim 22 wherein the retainer is detachably mounted to the bearing hub.

24. A method for pumping material through a centrifugal pump comprising the steps of:

pumping pumpage through an impeller assembly having a floating conical sleeve mounted on an inlet side of the impeller.

* * * * *